US012344925B2

(12) United States Patent
Hu et al.

(10) Patent No.: US 12,344,925 B2
(45) Date of Patent: Jul. 1, 2025

(54) NI-W BASED MEDIUM HEAVY ALLOY AND FORMING METHODS AND APPLICATIONS OF SAME

(71) Applicant: NORTHWESTERN UNIVERSITY, Evanston, IL (US)

(72) Inventors: Xiaobing Hu, Evanston, IL (US); Shaozun Liu, Beijing (CN); Chunxu Wang, Beijing (CN); Yong Li, Beijing (CN); Vinayak P. Dravid, Glenview, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 18/406,317

(22) Filed: Jan. 8, 2024

(65) Prior Publication Data

US 2024/0141468 A1 May 2, 2024

Related U.S. Application Data

(62) Division of application No. 17/606,484, filed as application No. PCT/US2020/031278 on May 4, 2020, now Pat. No. 11,905,585.

(60) Provisional application No. 62/843,657, filed on May 6, 2019.

(51) Int. Cl.
*C22F 1/10* (2006.01)
*C22C 19/03* (2006.01)

(52) U.S. Cl.
CPC ..... *C22F 1/10* (2013.01); *C22C 19/03* (2013.01)

(58) Field of Classification Search
CPC ..... C22C 19/03; C22F 1/10
See application file for complete search history.

(56) References Cited

U.S. PATENT DOCUMENTS 3,355,286 A * 11/1967 Williams ..... C22C 27/04 420/580
2010/0291406 A1* 11/2010 Suzuki ..... C22C 19/051 428/615
2012/0308428 A1* 12/2012 Forbes Jones ..... B05D 3/007 72/364

* cited by examiner

*Primary Examiner* — Jessee R Roe
(74) *Attorney, Agent, or Firm* — troutman pepper locke; Tim Tingkang Xia, Esq.

(57) ABSTRACT

A medium heavy alloy (MHA) and a fabrication method thereof are disclosed. The MHA includes a composition designed and processed such that the MHA has properties comprising a tensile strength of about 1527 MPa, a proof strength of about 1337 MPa, and an impact toughness of about 180 J, when the MHA is forged, and the tensile strength of about 1746 MPa, the proof strength of about 1571 MPa, and the impact toughness of about 55 J, when the MHA is agedly treated. The method includes providing a composition designed according to design specifications of the MHA; forming a cast alloy from the composition by a metallurgy process; and forged the cast alloy at a first temperature to form the MHA having properties that are the design specifications.

13 Claims, 4 Drawing Sheets

NI-W BASED MEDIUM HEAVY ALLOY AND FORMING METHODS AND APPLICATIONS OF SAME

CROSS-REFERENCE TO RELATED PATENT APPLICATIONS

This application is a divisional application of U.S. patent application Ser. No. 17/606,484, filed Oct. 26, 2021, which is a U.S. national stage application of PCT Patent Application No. PCT/US2020/031278, filed May 4, 2020, which itself claims priority to and the benefit of U.S. Provisional Application No. 62/843,657, filed May 6, 2019, which is incorporated herein in its entirety by reference.

FIELD OF THE INVENTION

The present invention relates generally to materials, and more particularly to a novel Ni—W based medium heavy alloy (MHA) with excellent static/dynamic properties and impact toughness, methods of making the same, and applications of the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

In contrast to lightweight alloys, heavy alloys with higher density (16-18 g/cm$^3$) have many unique attributes such as high rigidity, low vibration and high damping behavior. Because of the unique combination of density, mechanical strength, machinability, corrosion resistance and economy, tungsten heavy alloys (WHAs) are widely used in the aerospace, aviation, military and nuclear fields. WHAs typically contain 80-98 tungsten (W) in weight percent (wt %) and a small amount of other elements (e.g., Fe, Ni, Cu) and can be considered as a composite material, in which the hard body-centered cubic (BCC) W 'spheroids' is bonded by ductile face centered cubic (FCC) matrix. In some special applications such as kinetic energy penetrators, the used materials must exhibit good performance at high stain rate. However, because of the coarser grains associated with liquid-phase sintering and intrinsic weak deformation ability of BCC tungsten at room temperature, the flow stress of WHAs is generally not high enough (about 1800 MPa) although the critical failure rate is acceptable (about $5\times10^{-4}$ $s^{-1}$). Compared with the ultrahigh strength steel (UHSS) AerMet100 which has superior flow stress (about 2800 MPa), this demerit is more evident, limiting the widespread engineering applications of WHAs. However, the density of AerMet100 is so low (about 7.9 g/cm$^3$) that it is not likely to meet the requirement of some particular applications such as ordnance components where high density is a prerequisite for achieving high striking energy. In other aspect, adiabatic shear is an important failure form in case of the high strain rate deformation including hypervelocity impact, launching and high-speed machining. The localized adiabatic shear bands (ASBs), which are formed due to the local temperature rise and accelerated plastic instability, likely lead to a rapid deterioration of load carrying capacity or even a catastrophic failure. Because of poor resistance to fracture along ASBs, the dynamic properties of AerMet100 are inferior compared to WHAs.

In order to improve the yield strength and flow stress of WHAs, deformation strengthening through thermomechanical processes including swaging, hydrostatical extrusion and hot extrusion have been widely explored. Alternatively, grain refinement by addition of refractory metal (e.g., Mo, Re and Ta), inhibitors (such as oxide dispersoids), and adopting advanced fast sintering technique such as microwave sintering, spark plasma sintering have also been proven as effective approaches to improve the dynamic mechanical properties of WHAs. However, all above strengthening methods through deformation and grain refinement either involves a higher expenses cost or limited increment of strength.

Therefore, a heretofore unaddressed need exists in the art to address the aforementioned deficiencies and inadequacies.

SUMMARY OF THE INVENTION

One of the objectives of this invention is to design a novel medium heavy alloy (MHA) which simultaneously possesses a relative higher density, superior quasi-static and dynamic properties, and particularly to design an MHA of 57Ni-37W-5Co-1Ta fabricated using the casting technology. Compared to tungsten heavy alloys (WHA), this MHA not only largely reduces the difficulty in manufacturing and post working, but also enhances the toughness by about 10 times together with excellent quasi-static and dynamic properties. The superior strength-toughness is attributed to the face-centered cubic (FCC) matrix and/or the nano-sized secondary phases. While the superior dynamic performance is attributed to the widening of adiabatic shear bands (ASBs).

In one aspect of the invention, the novel MHA includes a composition designed and processed such that the MHA has properties comprising a tensile strength of about 1527 MPa, a proof strength of about 1337 MPa, and an impact toughness of about 180 J, when the MHA is forged, and the tensile strength of about 1746 MPa, the proof strength of about 1571 MPa, and the impact toughness of about 55 J, when the MHA is further agedly treated. The properties are design specifications of the MHA.

In one embodiment, the properties further comprise a density in a range of about 11.3-11.5 g/cm$^3$.

In one embodiment, the properties further comprise a flow stress of about 2000 MPa when the MHA is forged, and of about 2300 MPa when the MHA is further agedly treated.

In one embodiment, the MHA is both deformable and/or heat treatable.

In one embodiment, the MHA has an overall mechanical strength and dynamic performance that are further enhanced by means of microstructural tailoring through work hardening and aging treatments.

In one embodiment, the MHA is Ni—W based face centered cubic (FCC) alloy.

In one embodiment, the composition comprises about 57 wt % Ni, about 37 wt % W, about 5 wt % Co, and about 1 wt % Ta.

In one embodiment, the composition comprises W in a range of about 20-55 wt %, B in a range of about 0-0.1 wt %, Co in a range of about 0-40 wt %, Nb in a range of about 0-10 wt %, Ta in a range of about 0-20 wt %, V in a range of about 0-3 wt %, Zr in a range of about 0-3 wt %, Mo in a range of about 0-20 wt %, Ti in a range of about 0-5 wt, Al in a range of about 0-5 wt %, Fe in a range of about 0-10 wt %, Cr in a range of about 0-10 wt %, and Ni in balance.

In one embodiment, the MHA is fabricated by a direct solidification process.

In one embodiment, the MHA is forged at a temperature in a range of about 1000-1350° C. In one embodiment, the MHA is forged at about 1180° C.

In one embodiment, the MHA is further agedly treated at a temperature in a range of about 600-900° C. for a period of time in a range of about 2.5-7.5 h. In one embodiment, the MHA is agedly treated at about 750° C. for about 5 h.

In another aspect of the invention, the MHA is a Ni—W based FCC alloy comprising about 57 wt % Ni, about 37 wt % W, about 5 wt % Co, and about 1 wt % Ta.

In yet another aspect of the invention, the MHA includes a composition comprising W in a range of about 20-55 wt %, B in a range of about 0-0.1 wt %, Co in a range of about 0-40 wt %, Nb in a range of about 0-10 wt %, Ta in a range of about 0-20 wt %, V in a range of about 0-3 wt %, Zr in a range of about 0-3 wt %, Mo in a range of about 0-20 wt %, Ti in a range of about 0-5 wt, Al in a range of about 0-5 wt %, Fe in a range of about 0-10 wt %, Cr in a range of about 0-10 wt %, and Ni in balance.

The MHA in one embodiment has properties comprising a tensile strength of about 1527 MPa, a proof strength of about 1337 MPa, and an impact toughness of about 180 J, when the MHA is forged, and the tensile strength of about 1746 MPa, the proof strength of about 1571 MPa, and the impact toughness of about 55 J, when the MHA is agedly treated. Further, the properties has a flow stress of about 2000 MPa when the MHA is forged, and the flow stress of about 2300 MPa when the MHA is agedly treated. The properties may also have a density in a range of about 11.3-11.5 g/cm$^3$.

In a further aspect of the invention, the method for fabricating an MHA includes providing a composition designed according to design specifications of the MHA; forming a cast alloy from the composition by a metallurgy process; and forged the cast alloy at a first temperature to form the MHA having properties that are the design specifications. In one embodiment, the first temperature is in a range of about 1000-1350° C. In one embodiment, the first temperature is about 1180° C.

In one embodiment, the properties comprise a tensile strength of about 1527 MPa, a proof strength of about 1337 MPa, an impact toughness of about 180 J, and a flow stress of about 2000 MPa.

In one embodiment, the properties further comprise a density in a range of about 11.3-11.5 g/cm$^3$.

In one embodiment, the method further comprises aging the MHA at a second temperater for a period of time. In one embodiment, the second temperater in a range of about 600-900° C., and the period of time is a range of about 2.5-7.5 h. In one embodiment, the first temperature is about 750° C. and the period of time is about 5 h.

In one embodiment, the properties comprise a tensile strength of about 1746 MPa, a proof strength of about 1571 MPa, an impact toughness of about 55 J, a flow stress of about 2300 MPa, when the MHA is further agedly treated.

In one embodiment, the composition comprises 57 wt % Ni, about 37 wt % W, about 5 wt % Co, and about 1 wt % Ta.

In another embodiment, the composition comprises W in a range of about 20-55 wt %, B in a range of about 0-0.1 wt %, Co in a range of about 0-40 wt %, Nb in a range of about 0-10 wt %, Ta in a range of about 0-20 wt %, V in a range of about 0-3 wt %, Zr in a range of about 0-3 wt %, Mo in a range of about 0-20 wt %, Ti in a range of about 0-5 wt, Al in a range of about 0-5 wt %, Fe in a range of about 0-10 wt %, Cr in a range of about 0-10 wt %, and Ni in balance.

These and other aspects of the present invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

Figure 1:
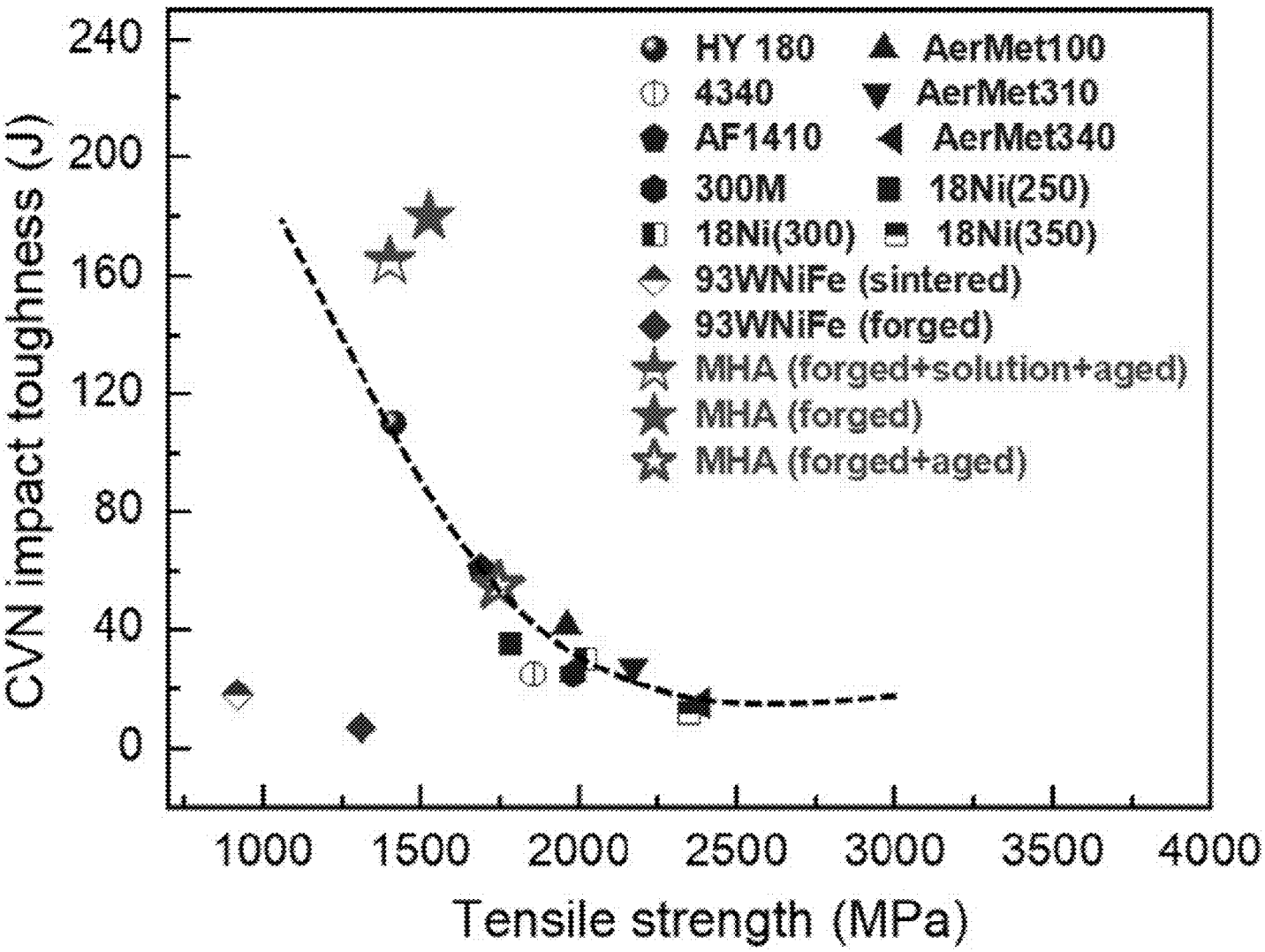
FIG. 1 shows comparisons of tensile strength and Charpy V-notch (CVN) impact toughness among medium heavy alloys (MHAs, labeled by red color), tungsten heavy alloys (WHAs, labeled by purple color) and several representative ultrahigh strength steels (UHSSs, labeled by blue color) including HY180, AF141, 4340, 300M, 18Ni(250), 18Ni (300), 18Ni(350), AerMet100, AerMet310, AerMet340. The density of WHAs, MHAs and UHSSs is in the range of 16-18 g/cm$^3$, 10-12 g/cm$^3$ and 7.8-8.0 g/cm$^3$, respectively. The schematic curved line highlighted the outstanding combination properties of strength and toughness for the MHAs, according to embodiments of the invention.

4C) and bulk matrix (FIG. 4D) for the forged MHA at the strain rates of 5330 $s^{-1}$ according to embodiments of the invention.

DETAILED DESCRIPTION OF THE INVENTION

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having", or "carry" and/or "carrying," or "contain" and/or "containing," or "involve" and/or "involving, and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In one aspect of this invention, a novel Ni—W based face centered cubic (FCC) alloy is disclosed, which is fabricated using the casting technology and exhibits excellent mechanical strength, dynamic properties and impact toughness. In certain embodiments, the density of the newly disclosed alloy is measured as about 11.39 g/$cm^3$, lower than that of the WHA (about 18 g/cm$^3$), but still 44% higher than that of the traditional ultrahigh strength steel (about 7.9 g/cm$^3$), which ensures the alloy's applications in some critical fields such as penetrator where both density and static/dynamic performance are required. In one embodiment, the alloys are designed as the medium heavy alloys (MHAs).

In certain embodiments, the novel MHA includes a composition designed and processed such that the MHA has properties comprising a tensile strength of about 1527 MPa, a proof strength of about 1337 MPa, and an impact toughness of about 180 J, when the MHA is forged, and the tensile strength of about 1746 MPa, the proof strength of about 1571 MPa, and the impact toughness of about 55 J, when the MHA is further aged, wherein the properties are design specifications of the MHA.

In one embodiment, the properties further comprise a density in a range of about 11.3-11.5 g/cm$^3$.

In one embodiment, the properties further comprise a flow stress of about 2000 MPa when forged, and of about 2300 MPa when agedly treated.

In one embodiment, the MHA is both deformable and/or heat treatable.

In one embodiment, the MHA has an overall mechanical strength and dynamic performance that are further enhanced by means of microstructural tailoring through work hardening and aging treatments.

In one embodiment, the MHA is Ni—W based face centered cubic (FCC) alloy. In one embodiment, the composition comprises 57 wt % Ni, about 37 wt % W, about 5 wt % Co, and about 1 wt % Ta.

In another embodiment, the composition comprises W in a range of about 20-55 wt %, B in a range of about 0-0.1 wt %, Co in a range of about 0-40 wt %, Nb in a range of about 0-10 wt %, Ta in a range of about 0-20 wt %, V in a range of about 0-3 wt %, Zr in a range of about 0-3 wt %, Mo in a range of about 0-20 wt %, Ti in a range of about 0-5 wt, Al in a range of about 0-5 wt %, Fe in a range of about 0-10 wt %, Cr in a range of about 0-10 wt %, and Ni in balance.

In one embodiment, the MHA is fabricated by a direct solidification process.

In one embodiment, the MHA is forged at a temperature in a range of about 1000-1350° C. In one embodiment, the MHA is forged at about 1180° C.

In one embodiment, the MHA is further aged at a temperature in a range of about 600-900° C. for a period of time in a range of about 2.5-7.5 h. In one embodiment, the MHA is aged at about 750° C. for about 5 h.

In another aspect of the invention, the method for fabricating an MHA includes providing a composition designed according to design specifications of the MHA; forming a cast alloy from the composition by various metallurgy techniques/processes such as vacuum induction melting (VIM), vacuum arc remelting (VAR), electro-slag remelting (ESR) and additive manufacturing (AM); and forged the cast alloy at a first temperature to form the MHA meeting the properties.

In one embodiment, the method further comprises aging the MHA at a second temperater for a period of time. In one embodiment, the second temperater in a range of about 600-900° C., and the period of time is a range of about 2.5-7.5 h.

In one embodiment, the as-cast alloy is forged twice at about 1180° C. and finally the bars with the diameter of 20 mm were obtained. To tailor the quasi-static and dynamic properties, some forged bars were further aged at about 750° C. for about 5 h.

In one embodiment, the composition is disclosed as above.

As fabricated, the MHA has properties comprising a tensile strength of about 1527 MPa, a proof strength of about 1337 MPa, an impact toughness of about 180 J, and a flow stress of about 2000 MPa, when the MHA is forged, and the tensile strength of about 1746 MPa, the proof strength of about 1571 MPa, and the impact toughness of about 55 J, and the flow stress of about 2300 MPa, when the MHA is further aged. In one embodiment, the properties further comprise a density in a range of about 11.3-11.5 g/cm$^3$.

According to the invention, the novel Ni—W based MHA has excellent balance of high density, high strength and high toughness. This unique combination make this MHA very attractive in some particular applications such as ordnance components where high density is a prerequisite for achieving high striking energy.

The Ni—W based MHA has, among other things, the following advantages over the commercially available WHAs.

The flow stress of MHA can be as high as 2300 MPa, which is 500 MPa than that of Aermert 100 but still 500 MPa higher than that of 93WNiFe WHA.

The density of the MHA is about 11.39 g/cm$^3$, which lower than that of the WHA (about 18 g/cm$^3$), but still 44% higher than that of the traditional ultrahigh strength steel (about 7.9 g/cm$^3$).

The Charpy V-notch (CVN) impact work of this MHA is 9 times and 3.5 times higher than those of the sintered 93WNiFe WHA and AerMet100.

The novel MHA can be fabricated directly by using the direct solidification method.

The novel MHA may find applications in a variety of fields such as for aviation, launching, nuclear industry, high temperature tools and ordnance components where both density and toughness/strength are required.

These and other aspects of the present invention are further described below. Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Exemplary Examples of Medium Heavy Alloys

In this non-limiting exemplary example, the experimental medium heavy alloys (MHAs) include about 57 wt % Ni, about 37 wt % W, about 5 wt % Co, and about 1 wt % Ta. Then, the as-cast alloys were forged twice at about 1180° C. and finally the bars with the diameter of about 20 mm were obtained. To tailor the quasi-static and dynamic properties, some forged bars were further subjected to an aged treatment at about 750° C. for about 5 h. Some forged bars were subjected to a combined solution (about 1005° C. about 1 h) and aging treatment (about 750° C. for about 5 h). All the quasi-static and dynamic tests were performed on these MHAs. In the quasi-static tensile test, the strain rate was about $5\times10^{-4}$ s$^{-1}$. The uniaxial dynamic compression experiments were performed using the split Hopkinson pressure bar (SHPB) under different strain rates ranging from about 1500 s$^{-1}$ to about 6000 s$^{-1}$ at room temperature. The test pieces possessed cylindrical shape with a dimension of φ4 mm×4 mm. The Charpy impact testing was carried out using the 'V' gap specimens with a dimension of about 10 mm×10 mm×55 mm. Regarding the Charpy V-notch (CVN) impact toughness of WHAs, there is little knowledge in available literatures. Thus, 93WNiFe were prepared using the powder metallurgic method, which delivered similar static properties as previous work. Optical microscopy was performed using Leica EC3. The back-scattering electron (BSE) and electron back-scatter diffraction (EBSD) images were obtained using Sirion 200 scanning electron microscope (SEM). Transmission electron microscopy (TEM) observations were conducted on JEM-2100F.

TABLE 1

Comparisons of the quasi-static tensile properties of MHAs, WHAs and AerMet100.

| Specimens | $R_m$ [MPa] | $R_{p0.2}$ [MPa] | A [%] | CVN [J] | Density [g/cm$^3$] |
|---|---|---|---|---|---|
| MHA (forged) | 1527 | 1337 | 18.5 | 180 | 11.4 |
| MHA (forged + age) | 1746 | 1571 | 14 | 55 | 11.4 |
| MHA (solution + age) | 1403 | 919 | 36 | 165 | 11.4 |
| AerMet100 | 1965 | 1758 | 14 | 40 | 7.9 |
| 93WNiFe (sintered) | 920 | 610 | 28 | 18 | 17.7 |

As listed in Table 1, this newly designed MHA at forged state shows about 66% larger in tensile strength ($R_m$) and about 119.2% larger in proof strength at non-proportional extension ($R_{p0.2}$) than those of the sintered 93WNiFe, although they are about 22.3% and about 23.9% less than those of AerMet100. An interesting phenomenon is that the CVN impact work of this MHA is extremely high, with about 9 times and about 3.5 times higher than those of the sintered 93WNiFe and AerMet100, respectively. Subjected to a combined solution and aged treatment, the tensile strength and yield strength of the MHA decreased by about 8.1% and about 31.3% respectively compared with those of the forged MHAs. This is mainly resulted from the decrease of the deformation strengthening effect due to the solution treatment. In contrast to the toughness of the forged MHAs, the toughness of the forged MHAs subjected to a combined solution and aging treatment decrease by about 8.33%. This is mainly resulted the precipitation of secondary phases in the following aging stage. Compared with forged MHAs, the $R_m$ and $R_{p0.2}$ of the MHAs subjected to further aging treatment can be enhanced by about 14.3% and about 17.5%, respectively, which significantly decrease the strength gap between WHAs and AerMet100. However, increase of the strength is at the expense of the impact work. But the CVN impact work for the MHA at aged state is still 2 times higher than that of sintered 93WNiFe and about 35% higher than that of AerMet100. More generally, comparisons of the tensile strength and impact toughness among the MHAs, WHAs and several representative UHSSs are shown in FIG. 1. It is clearly demonstrated that the newly designed MHA shows excellent quasi-static properties with a unique combination of high strength, high density and high toughness.

Figure 2A:
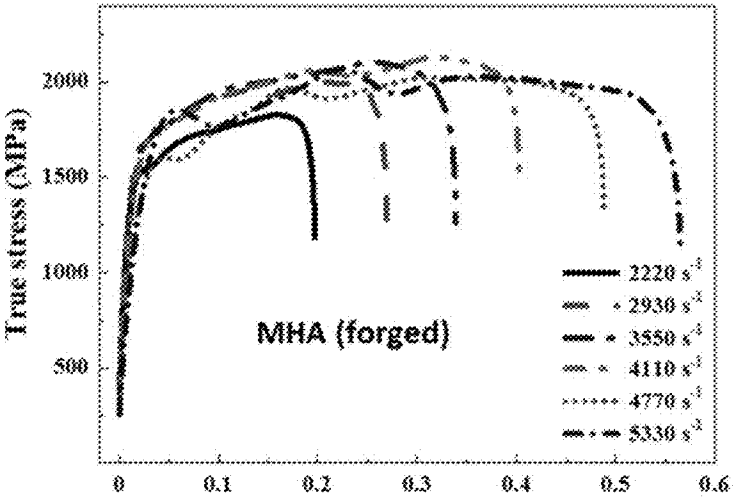
FIGS. 2A-2D show room temperature compression true stress-strain curves of the forged MHAs (FIG. 2A) and the forged MHAs subjected to further aging treatment (FIG. 2B) according to embodiments of the invention, AerMet100 (FIG. 2C) and sintered 93WNiFe (FIG. 2D) at different loading rates ranging from about 1000 s$^{-1}$ to about 6000 s$^{-1}$.
Figure 2B:
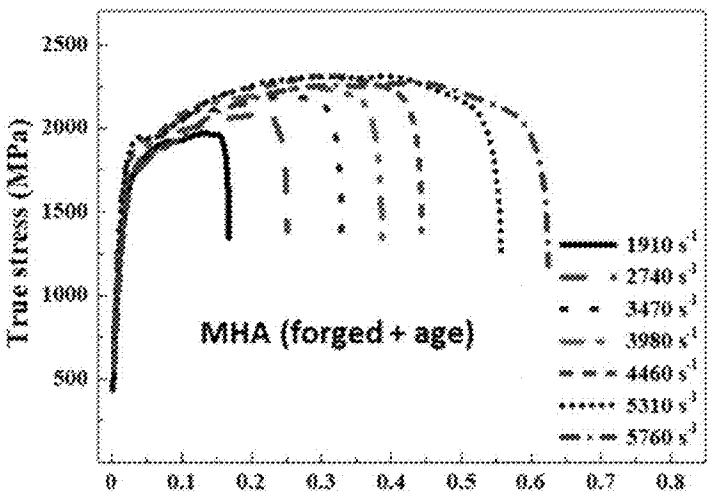
Figure 2C:
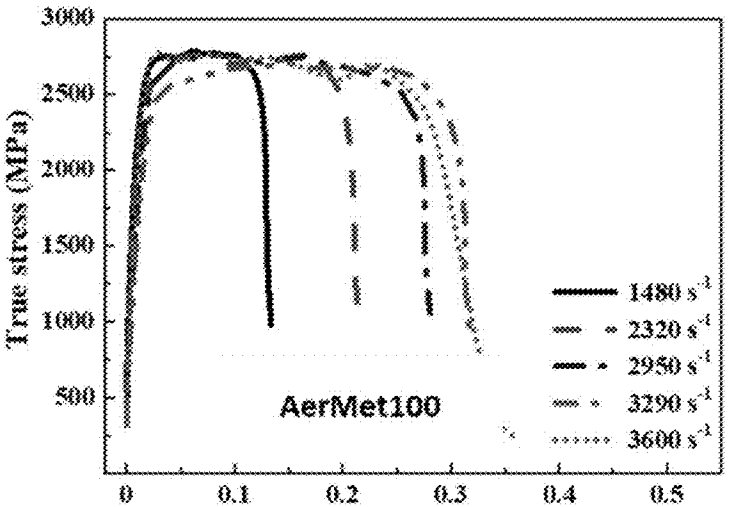
Figure 2D:
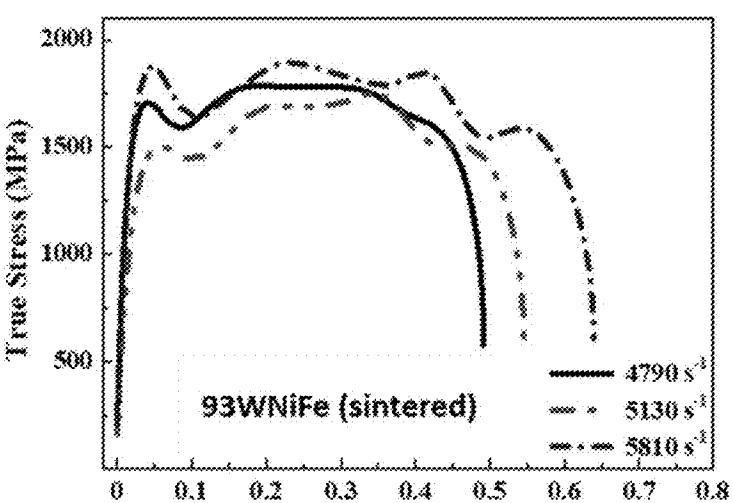

In order to evaluate the dynamic properties of the MHAs, SHPB experiments were carried out. FIGS. 2A and 2B show the uniaxial dynamic compress true stress-strain curves of the forged MHA and forged MHA subjected to further aged treatment. Due to strain hardening, the flow stress of forged and further aged MHAs can reach 2000 MPa and 2300 MPa, respectively, which is obviously higher than the quasi-static strength of both materials. Their impact absorption energies are both above 1000 MJ·cm$^{-3}$. Under the almost highest achievable strain rates (about 5330 s$^{-1}$ for forged MHA; about 5760 s$^{-1}$ for further aged MHA) using the SHPB holder, no stress collapse occurred in all tested specimens. Instead of breaking, these specimens show synergy deformation macroscopically. However, for AerMet100 as shown in FIG. 2C, although the flow stress is about 200 MPa higher, the highest achievable strain rate is only around 3290 s$^{-1}$ and the true strain is less than about 0.3 and the impact absorption energies is only around 683 MJ·cm$^{-3}$, which are significantly lower than those of the MHAs. In other aspects, although the critical strain rate for sintered 93WNiFe is as high as about 5810 s$^{-1}$, the delivered flow stress is only about 1700 MPa, which is 300 MPa lower than that of forged MHA and about 500 MPa lower than that of forged MHA subjected to further aged treatment. It is obvious that the newly designed MHA exhibits much better overall dynamic performances than those of WHAs and AerMet100.

Figures 3A, 3B, 3C, 3D, 3E, 3F:
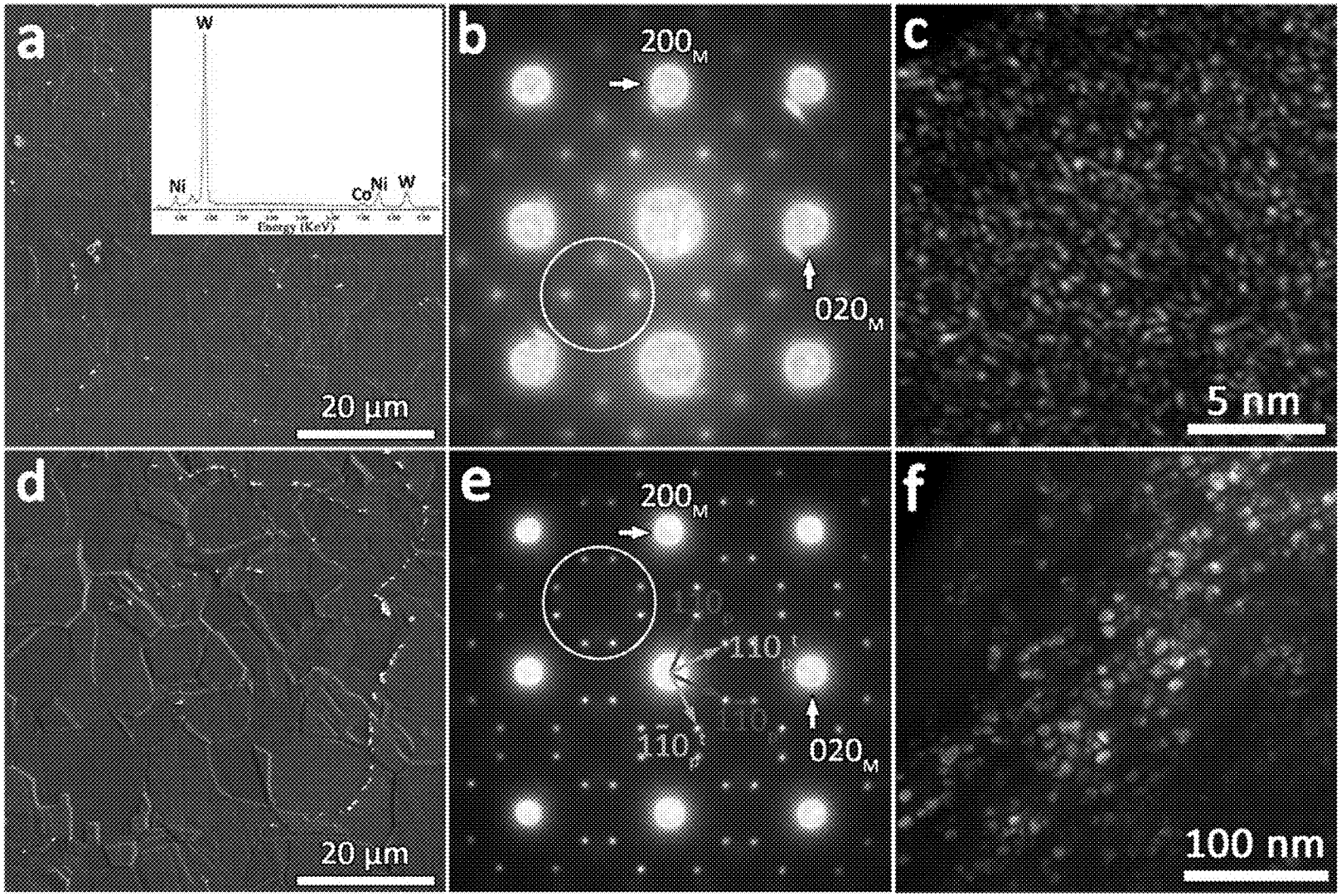
FIGS. 3A-3B show SEM-BSE micrographs showing the macro-structural features of the forged MHA (FIG. 3A) and the forged MHAs subjected to further aging treatment (FIG. 3D), according to embodiments of the invention. Inset in FIG. 3A shows the EDS profile obtained from the particle with brighter contrast.
FIGS. 3C-3D show respectively electron diffraction patterns (EDPs) and corresponding dark field (DF) TEM image acquired from the forged MHA according to embodiments of the invention.
FIGS. 3E-3F show respectively EDPs and DF TEM image acquired from the further aged MHAs according to another embodiments of the invention.

The microstructural features of forged MHA and forged MHA subjected to further aging treatment are shown in FIGS. 3A-3F. The grain size of matrix in both samples are about 10 μm. The grain size of the smaller particles with brighter contrast in FIGS. 3A and 3D are about 0.5-1.5 μm. Inset EDS profile in FIG. 3A shows that these particles are approximately composed of about 87% W, about 11% Ni, about 2% Co in wt %. Thereby, these bright particles in FIGS. 3A and 3D likely correspond to the undissolved tungsten with minor Ni and Co solid solution. The selected area electron diffractions (SAEDs) in FIGS. 3B and 3E were obtained from forged MHA and further aged samples respectively. The distributions of the main patterns are the same, which can be indexed as the austenite matrix along direction. However, there are additional weak spots in-between the main reflections as shown in FIGS. 3B and 3E. According to previous work, these relatively weak spots are resulted from the short range ordering of W atoms and $Ni_4W$ precipitates in Ni—W solid solute matrix respectively. The dark field (DF) images in FIGS. 3C and 3F were obtained using the spots indicated in FIGS. 3B and 3E. It is found that the size of the precipitates with brighter contrast in FIG. 3C is only about 0.4 nm, which indicated the strong short range ordering of W in Ni matrix in forged MHA sample. While for the forged MHA subjected to further aging treatment, it is clearly that the short range ordering disappears and $Ni_4W$ with the size of approximately 20 nm precipitated in the matrix. Additionally, these nano-sized $Ni_4W$ precipitates keep a good orientation relationship (OR) with the matrix. This OR can be described as $(130)_p//(200)_M$, $[001]_M$, where subscript p and M represents $Ni_4W$ precipitates and matrix respectively. The index of precipitates by different colors in FIG. 3E indicate two orientation variants, which are resulted from the difference in symmetry between tetragonal $Ni_4W$ and cubic matrix.

Figures 4A, 4B, 4C, 4D:
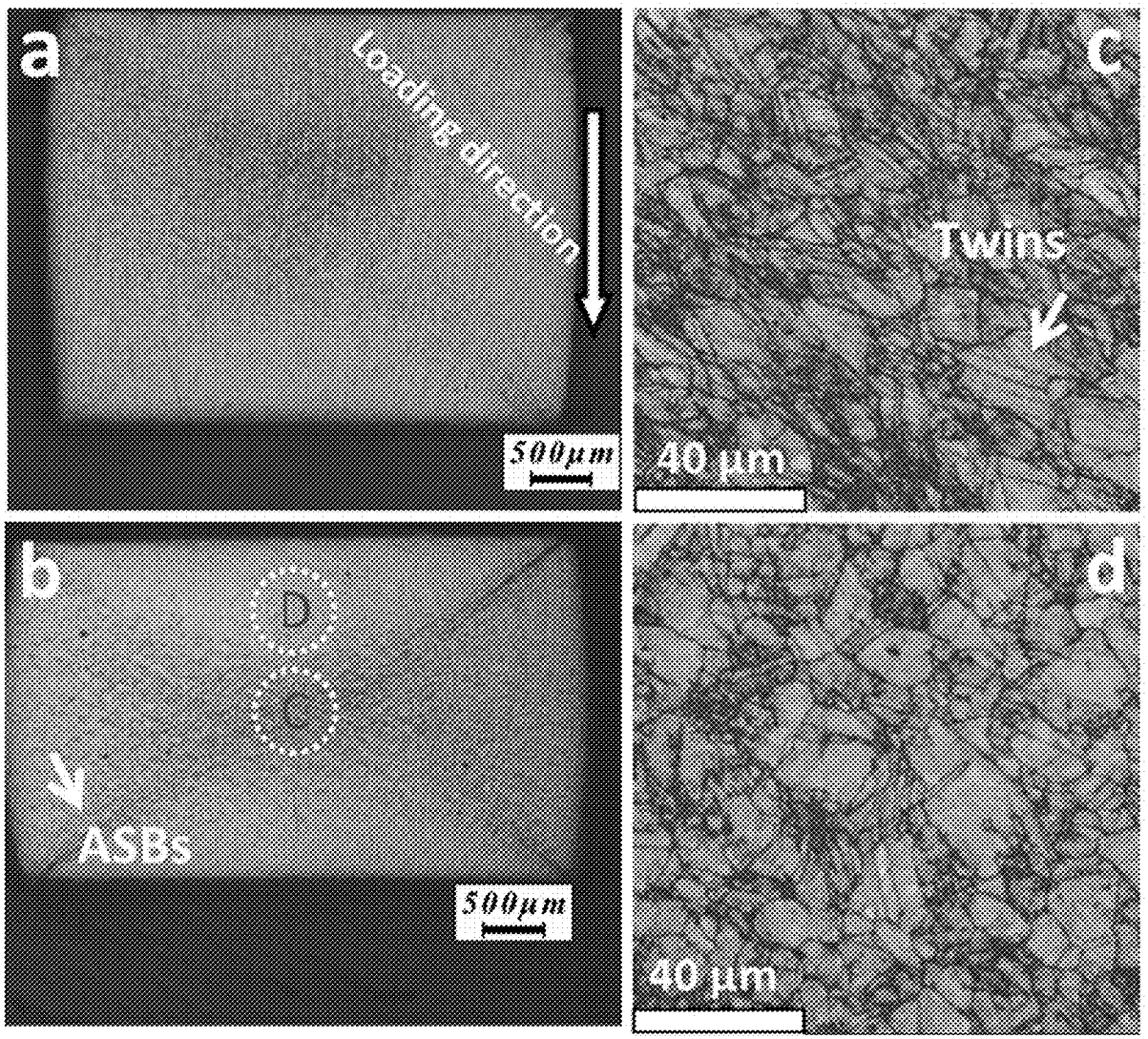
FIGS. 4A-4B show optical images showing the general macrostructural features of ASB for forged MHA at the strain rate of 2220 s$^{-1}$ and 5330 s$^{-1}$, respectively, according to embodiments of the invention.
FIGS. 4C-4D show band contrast maps based on EBSD characterizations corresponding to the region of ASB (FIG.

FIGS. 4A and 4B show the microstructures of the forged MHA under minimum and maximum strain rate, respectively. At the strain rate of about 2220 s$^{-1}$, forged MHA exhibits fuzzy ASBs along a diagonal direction, which indicates that the strain concentration is not so strong at this deformed condition. When the strain rate increased to about 6000 s$^{-1}$, deformation of the grains becomes larger and more obvious ASBs could be observed along the diagonal direction because of strong strain concertration. The width of these ASBs is about 100-150 μm, which is around several dozen times larger than that of the ASBs in AerMet100. FIGS. 4C and 4D shows the microstructual features of the region from ASBs and its neighoring bulk matrix as indicated in FIG. 4B. It is clearly demonstrated that there are not large difference in microstcutrues between ASBs and the neighboring matrix except that there are more deformation defects such as twins and dislocations in ASBs. Additionaly, the materials in ASBs rarely undergo thermal recovery even though the high strain rate produces lots of heat within ASB during dynamic deformation process.

According to the invention, MHA possesses the Ni—W based FCC structure, which ensures the toughness. Combined with the strengthening effect from the short range ordering of W and/or $Ni_4W$ precipitates, a good cooperation of strengthens and toughness can be achieved. Compared to AerMet100, the MHAs show excellent dynamic performance. The origins of these superior dynamic properties are discussed based on the following aspects. First, due to more mobile slip systems in FCC matrix in contrast to BCC matrix in AerMet100, MHA shows much larger strain hardening rate. Second, the ASBs for the MHA are very broad, which indicated that the strain concentration within ASBs can be easily released. Third, the specific heat capacity of the MHAs are measured as about 3.47 $J \cdot cm^{-3} \cdot K^{-1}$, which has a similar value as that of the AerMet100 (about 3.59 $J \cdot cm^{-3} \cdot K^{-1}$). Thus, there should be minor difference in temperature increase under the same heat generated during deformation. Fourthly, the thermal conductivity of AerMet100 is about 18.42 $W \cdot m^{-1} \cdot K^{-1}$, which is more than twice the value of the MHAs (about 8.41 $W \cdot m^{-1} \cdot K^{-1}$). The temperature rise resulted from deformation in AerMet100 should be much easier to decrease than the MHA. However, the dynamic deformation ability of AerMet100 is still very poor. Thus, the MHAs should have a much stronger ability in resisting thermal softening. The temperature and stress concentration of the deformation zone can be easily released by the tough matrix in the form of defects including twins and dislocation, which will result in the broadening of ASB within MHA. The nerighbouring matrix was deformed synergistically together with the ASBs. This is very critical in preventing the preferred fracture along ASBs at high strain rate.

Briefly, the invention discloses, among other things, a novel MHA (about 11.4 $g/cm^3$) with superior static/dynamic properties and impact toughness and its design. The tensile strength ($R_m$) and proof strength ($R_{p0.2}$) of the MHA at forged condition are around about 1527 MPa and about 1337 MPa, respectively. Subjected to aged treatment, $R_m$ and $R_{p0.2}$ approach to about 1746 MPa and about 1571 MPa, respectively. The impact toughness of the forged MHA and further aged MHA is about 180 J and about 55 J respectively. During the SHPB experiments, the MHAs at different states do not show any obvious fracture even at the highest achievable strain rate (about 6000 $s^{-1}$). The flow stress of forged and further aged MHAs approach to about 2000 MPa and about 2300 MPa respectively. The superior dynamics properties of MHA are resulted from the synergistic deformation between ASBs and austenite matrix. More importantly, this MHA is both deformable and heat treatable. Therefore, the overall mechanical strength and dynamic performance can be further enhanced by means of microstructural tailoring through work hardening and aging treatment.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

LIST OF REFERENCES

[1] W. Cai, Y. Li, R. Dowding, F. Mohamed, E. Lavernia, Rev. Part. Mater. 3 (1995) 71-131.
[2] Y. Li, K. Hu, X. Li, X. Ai, S. Qu, Mater. Sci. Eng. A 573 (2013) 245-252.
[3] D. P. Xiang, L. Ding, Y. Y. Li, X. Y. Chen, T. M. Zhang, Mater. Sci. Eng. A 578 (2013) 18-23.
[4] S. Yadav, K. T. Ramesh, Mater. Sci. Eng. A 203 (1995) 140-153.
[5] D. S. Kim, S. Nemat-Nasser, J. B. Isaacs, D. Lischer, Mech. Mater. 28 (1998) 227-236.
[6] D.-K. Kim, S. Lee, W. Hyung Baek, Mater. Sci. Eng. A 249 (1998) 197-205.
[7] K. Cho, Y. C. Chi, J. Duffy, Metall. Trans. A 21 (1990) 1161-1175.
[8] D. Hu, K. Meng, H. Jiang, Procedia Eng. 99 (2015) 1459-1464.
[9] D. Y. Hu, K. P. Meng, H. L. Jiang, J. Xu, R. R. Liu, Mater. Design 87 (2015) 759-772.
[10] U. Ravi Kiran, A. Sambasiva Rao, M. Sankaranarayana, T. K. Nandy, Int. J. Refract. Met. Hard Mater. 33 (2012) 113-121.
[11] D. Rittel, R. Levin, A. Dorogoy, Metall. Mater. Trans. A 35 (2004) 3787.
[12] B. Katavić, Z. Odanović, M. Burzić, Mater. Sci. Eng. A 492 (2008) 337-345.
[13] D.-K. Kim, S. Lee, J.-W. Noh, Mater. Sci. Eng. A 247 (1998) 285-294.
[14] N. Durlu, N. K. ÇaliŞkan, Ş. Bor, Int. J. Refract. Met. Hard Mater. 42 (2014) 126-131.
[15] Z.-H. Zhang, F.-C. Wang, S.-K. Li, L. Wang, Mater. Sci. Eng. A 435-436 (2006) 632-637.
[16] Y. Yang, H. Lianxi, W. Erde, Mater. Sci. Eng. A 435-436 (2006) 620-624.
[17] J. Liu, S. Li, A. Fan, H. Sun, Mater. Sci. Eng. A 487 (2008) 235-242.
[18] X. Gong, J. L. Fan, F. Ding, M. Song, B. Y. Huang, J. M. Tian, Mater. Sci. Eng. A 528 (2011) 3646-3652.
[19] X. Zhou, S. Li, J. Liu, Y. Wang, X. Wang, Mater. Sci. Eng. A 527 (2010) 4881-4886.
[20] J. Liu, S. Li, X. Zhou, Z. Zhang, H. Zheng, Y. Wang, Scripta Mater. 59 (2008) 1271-1274.
[21] A. Bose, R. M. German, Metall. Trans. A 21 (1990) 1325-1327.
[22] C.-S. Hsu, S.-T. Lin, Scripta Mater. 46 (2002) 869-873.
[23] U. Ravi Kiran, A. Panchal, M. Prem Kumar, M. Sankaranarayana, G. V. S. Nageswara Rao, T. K. Nandy, J. Alloy. Compd. 709 (2017) 609-619.

[24] U. Ravi Kiran, A. Panchal, M. Sankaranarayana, G. V. S. Nageswara Rao, T. K. Nandy, Mater. Sci. Eng. A 640 (2015) 82-90.

[25] K. H. Lee, S. I. Cha, H. J. Ryu, S. H. Hong, Mater. Sci. Eng. A 452-453 (2007) 55-60.

[26] H. J. Ryu, S. H. Hong, Mater. Sci. Eng. A 363 (2003) 179-184.

[27] D. Gu, Y. Li, H. Wang, Q. Jia, G. Zhang, Int. J. Refract. Met. Hard Mater. 44 (2014) 113-122.

[28] K. H. Lee, S. I. Cha, H. J. Ryu, S. H. Hong, Mater. Sci. Eng. A 458 (2007) 323-329.

[29] A. Upadhyaya, S. K. Tiwari, P. Mishra, Scripta Mater. 56 (2007) 5-8.

[30] A. Mondal, A. Upadhyaya, D. Agrawal, Mater. Sci. Eng. A 527 (2010) 6870-6878.

[31] M. B. Shongwe, S. Diouf, M. O. Durowoju, P. A. Olubambi, M. M. Ramakokovhu, B. A. Obadele, Int. J. Refract. Met. Hard Mater. 55 (2016) 16-23.

[32] V. N. Chuvil'deev, A. V. Moskvicheva, G. V. Baranov, A. V. Nokhrin, Y. G. Lopatin, V. Y. Belov, Y. V. Blagoveshchenskii, S. V. Shotin, Tech. Phys. Lett. 35 (2009) 1036.

[33] K. Hu, X. Li, S. Qu, Y. Li, Metall. Mater. Trans. A 44 (2013) 923-933.

[34] K. Hu, X. Li, M. Guan, S. Qu, X. Yang, J. Zhang, Int. J. Refract. Met. Hard Mater. 58 (2016) 117-124.

[35] R. M. German, L. L. Bourguignon, B. H. Rabin, JOM 37 (1985) 36-39.

[36] N. Senthilnathan, A. R. Annamalai, G. Venkatachalam, Mater. Sci. Eng. A 710 (2018) 66-73.

[37] H. M. Tawancy, Mater. Sci. Forum 633-634 (2009) 421-435.

[38] A. J. Sunwoo, R. Becker, D. M. Goto, T. J. Orzechowski, H. K. Springer, C. K. Syn, J. Zhou, Scripta Mater. 55 (2006) 247-250.

[39] C. J. Hu, P. Y. Lee, J. S. Chen, J Chin. Inst. Eng. 25 (2002) 99-107.

[40] G. R. Speich, D. S. Dabkowski, L. F. Porter, Metall. Trans. 4 (1973) 303-315.

[41] K. J. Handerhan, W. M. Garrison, N. R. Moody, Metall. Trans. A 20 (1989) 105-123.

[42] R. O. Ritchie, B. Francis, W. L. Server, Metall. Trans. A 7 (1976) 831-838.

[43] G. Y. Lai, W. E. Wood, R. A. Clark, V. F. Zackay, E. R. Parker, Metall. Trans. 5 (1974) 1663-1670.

[44] R. Padmanabhan, W. E. Wood, Corrosion 41 (1985) 688-699.

[45] A. J. Birkle, Trans. ASM 58 (1965) 123-139.

[46] Carpenter Technology Corporation, AerMet 100 Alloy, http://cartech.ides.com/datasheet.aspx?i=103&e=161&c=techart, accessed: March, 2011.

[47] Carpenter Technology Corporation, AerMet 310 Alloy, http://cartech.ides.com/datasheet.aspx?i=101&e=158&c=TechArt&FMT=PRINT, accessed: September, 2007.

[48] Carpenter Technology Corporation, AerMet 340 Alloy, http://cartech.ides.com/datasheet.aspx?i=101&e=338&c=TechArt&FMT=PRINT, accessed: May, 2007.

What is claimed is:

1. A method for fabricating an alloy, comprising:

providing a composition designed according to design specifications of the alloy;

forming a cast alloy from the composition by a metallurgy process;

forging the cast alloy at a first temperature to form the alloy having properties that are the design specifications; and aging the alloy at a second temperature for a period of time, wherein the second temperature in a range of about 600-900° C., and the period of time is a range of about 2.5-7.5h, wherein the properties comprise a tensile strength of about 1527 MPa, a proof strength of about 1337 MPa, an impact toughness of about 180 J, and a density in a range of about 11.3-11.5 g/cm$^3$.

2. The method of claim 1, wherein the first temperature is in a range of about 1000-1350° C.

3. The method of claim 2, wherein the first temperature is about 1180° C.

4. The method of claim 1, wherein the properties further comprise a flow stress of about 2000 MPa.

5. A method for fabricating an alloy, comprising:

providing a composition designed according to design specifications of the alloy;

forming a cast alloy from the composition by a metallurgy process; and forging the cast alloy at a first temperature to form the alloy having properties that are the design specifications, wherein the composition comprises about 57 wt % Ni, about 37 wt % W, about 5 wt % Co, and about 1 wt % Ta.

6. The method of claim 5, further comprising aging the alloy at a second temperature for a period of time.

7. The method of claim 6, wherein the second temperature in a range of about 600-900° C., and the period of time is a range of about 2.5-7.5h.

8. The method of claim 7, wherein the second temperature is about 750° C. and the period of time is about 5h.

9. The method of claim 6, wherein the properties comprise a tensile strength of about 1746 MPa, a proof strength of about 1571 MPa, and an impact toughness of about 55 J.

10. The method of claim 9, wherein the properties further comprise a flow stress is about 2300 MPa.

11. The method of claim 1, wherein the composition comprises about 57 wt % Ni, about 37 wt % W, about 5 wt % Co, and about 1 wt % Ta.

12. The method of claim 1, wherein the composition comprises W in a range of about 20-55 wt %, B in a range of about 0-0.1 wt %, Co in a range of about 0-40 wt %, Nb in a range of about 0-10 wt %, Ta in a range of about 0-20 wt %, V in a range of about 0-3 wt %, Zr in a range of about 0-3 wt %, Mo in a range of about 0-20 wt %, Ti in a range of about 0-5 wt, Al in a range of about 0-5 wt %, Fe in a range of about 0-10 wt %, Cr in a range of about 0-10 wt %, and Ni in balance.

13. A method for fabricating an alloy, comprising:

providing a composition designed according to design specifications of the alloy;

forming a cast alloy from the composition by a metallurgy process; and forging the cast alloy at a first temperature to form the alloy having properties that are the design specifications, wherein the alloy is a Ni—W based face centered cubic (FCC) alloy; and wherein the properties comprise a tensile strength of about 1527 MPa, a proof strength of about 1337 MPa, an impact toughness of about 180 J, and a density in a range of about 11.3-11.5 g/cm$^3$.

* * * * *